US008069541B2

(12) United States Patent
Reutter et al.

(10) Patent No.: US 8,069,541 B2
(45) Date of Patent: Dec. 6, 2011

(54) DEVICE FOR NEEDLING A NONWOVEN WEB

(75) Inventors: Tilman Reutter, Eidenberg (AT); Andreas Plump, Linz (AT); Andreas Mayer, Linz (AT); Daniel Bu, Ansfelden (AT)

(73) Assignee: Oerlikon Textile GmbH & Co. KG (DE)

( * ) Notice: Subject to any disclaimer, the term of this patent is extended or adjusted under 35 U.S.C. 154(b) by 0 days.

(21) Appl. No.: 12/664,581

(22) PCT Filed: Jun. 2, 2008

(86) PCT No.: PCT/EP2008/056783

§ 371 (c)(1),
(2), (4) Date: Jun. 18, 2010

(87) PCT Pub. No.: WO2008/151961

PCT Pub. Date: Dec. 18, 2008

(65) Prior Publication Data

US 2010/0242240 A1 Sep. 30, 2010

(30) Foreign Application Priority Data

Jun. 15, 2007 (DE) ..... 10 2007 027 559

(51) Int. Cl.
*D04H 18/00* (2006.01)

(52) U.S. Cl. ..... 28/114

(58) Field of Classification Search ..... 28/107, 28/114, 113, 108–112, 115; 112/80.42, 80.41
See application file for complete search history.

(56) References Cited

U.S. PATENT DOCUMENTS 5,511,294 A * 4/1996 Fehrer ..... 28/113
5,548,881 A * 8/1996 Ludwig ..... 28/114
5,568,678 A * 10/1996 Fehrer ..... 28/115
5,732,453 A 3/1998 Dilo et al.
6,161,269 A 12/2000 Dilo et al.
(Continued)

FOREIGN PATENT DOCUMENTS

DE 19615697 A1 * 3/1997
(Continued)

OTHER PUBLICATIONS

International Preliminary Report on Patentability and Written Opinion for International Application No. PCT/EP2008/056783 received Jan. 28, 2010.

(Continued)

*Primary Examiner* — Amy Vanatta
(74) *Attorney, Agent, or Firm* — Alston & Bird LLP

(57) ABSTRACT

The invention relates to a device for needling a nonwoven web having on the base thereof at least one needle bar comprising a needle board having a plurality of needles. The needle bar is held by a bar carrier on which a vertical drive engages for oscillating motion of the bar carrier for an up and down movement. A superimposed horizontal drive is also associated with the bar carrier, by which a back-and-forth movement is induced. The horizontal drive has two eccentric drives coupled to a horizontal guide. The eccentric drives are each formed by a connecting rod and a crankshaft coupled to a connecting head of the connecting rod. According to the invention, the connecting rods are coupled to the horizontal guide with the connecting rod ends thereof in a diagonal orientation, the center axes of the connecting rods forming an angle.

15 Claims, 5 Drawing Sheets

U.S. PATENT DOCUMENTS

| | | | | |
|---|---|---|---|---|
| 6,266,856 | B1 * | 7/2001 | Fehrer et al. | 28/107 |
| 6,389,665 | B1 | 5/2002 | Fuchs et al. | |
| 6,568,051 | B2 * | 5/2003 | Legl et al. | 28/114 |
| 6,748,633 | B2 * | 6/2004 | Legl et al. | 28/114 |
| 6,785,940 | B1 * | 9/2004 | Muller | 28/114 |
| 2003/0056347 | A1 * | 3/2003 | Pum | 28/107 |
| 2006/0288549 | A1 * | 12/2006 | Jean et al. | 28/107 |
| 2007/0006432 | A1 | 1/2007 | Noel et al. | |
| 2009/0119894 | A1 | 5/2009 | Reutter et al. | |

FOREIGN PATENT DOCUMENTS

| | | |
|---|---|---|
| DE | 20 2006 008717 | 8/2006 |
| GB | 2 408 517 | 6/2005 |

OTHER PUBLICATIONS

International Search Report for International Application No. PCT/EP2008/056783.

* cited by examiner

DEVICE FOR NEEDLING A NONWOVEN WEB

BACKGROUND OF THE INVENTION

1. Field of the Invention

The invention concerns a device for needling of a nonwoven web.

2. Description of Related Art

The known device is used for consolidation and structuring of nonwovens. For this purpose, a nonwoven web is punctured by a number of needles, which are guided in an oscillating up and down movement. During the process, the needles are guided with an oscillating vertical movement, in order to consolidate the fiber material in the nonwoven web. The nonwoven web during this process is continuously moved forward with an advance, preferably executed by rolls. Since the needles are not smooth, but are provided with counter-hooks opened in the puncturing direction, filaments of the nonwoven are grasped during puncturing and reoriented in the nonwoven. Because of this, the desired felting and consolidation effect occurs in the nonwoven. In order not to obtain undesired deformations, which lead, for example, to warping or elongated hole formation in the needled material, during puncturing of the needles in the nonwoven web, because of advance of the nonwoven web, the needles are guided with a superimposed horizontal movement. In this case, the movement of the needles is aligned in the advance direction of the nonwoven web. To carry out a vertical movement and a superimposed horizontal movement of the needles, essentially two different drive variants are known in the prior art.

A generic device for needling of a nonwoven web is known from DE 197 30 532 A1, in which a needle bar is connected to a vertical drive to execute an up and down movement and to a horizontal drive to execute a back and forth movement. The horizontal drive is formed by two oppositely driven eccentric drives, which are formed from two parallel connecting rods and crankshafts connected to the connecting rods. The phase positions of the crankshafts are adjustable relative to each other, so that the horizontal stroke transferred by the connecting rods to a coupling element is adjustable in size. The horizontal movement is transferred from the coupling element directly to a bar support or through an intermediate coupling mechanism. The separate horizontal drive of the known device, however, requires complicated mechanisms, which results in insufficient stability and insufficient guiding of the needle bar, especially at higher passage speeds. Consequently, machine dynamic problems are to be expected when larger stroke frequencies are implemented with simultaneous stroke adjustment capability in the known device.

In a second variant of the drive technique for such devices, which is known, for example, from DE 103 55 590 A1, the vertical and horizontal movement is executed by a common drive. Here, two phase-adjustable crankshafts are used in conjunction with two connecting rods positioned obliquely relative to each other, whose connecting rod top ends meet at a point. Depending on the phase rotation of the crankshafts, a movement similar to an ellipse is obtained with variable horizontal and vertical stroke. Such concepts, however, have deficient speed stability and parallel guiding of the needle bar relative to the nonwoven web is also not possible.

In practice, however, there is an increasing desire to needle the nonwoven web with high speed and, if possible, variable horizontal stroke.

In order to generate the movement of a needle bar with separate vertical drive and horizontal drive, additional devices are known in the prior art, as disclosed, for example, in DE 196 15 697. Here, the horizontal drive is formed by an eccentric drive, which has a connecting rod cooperating with a crankshaft. The connecting rod acts with its connecting rod top end directly on a bar carrier, on whose bottom a needle bar is held. Such devices do permit higher passage speeds of the nonwoven web, but have the major drawback that the horizontal stroke is not variably adjustable.

Another device for needling of a nonwoven web is known from DE 100 43 534 A1, in which the bar carrier is formed by a pushrod guided in a pivot tube. The pivot tube is pivoted back and forth relative to a pivot axis. To this extent, the bar carrier is pivoted via a pivot drive relative to the pivot axis. The device as well as the pivot drive are therefore not appropriate for guiding the needle board or boards parallel to the nonwoven web.

It is now the task of the invention to modify a device for needling of a nonwoven web of the generic type, so that nonwovens can be needled in high quality at high passage speeds with variable stroke adjustment and high stroke frequencies.

SUMMARY OF VARIOUS EMBODIMENTS

This task is solved according to the invention in that the connecting rods are connected with their connecting rod top ends in an oblique position to the horizontal linkage, the connecting rods forming an angle with their center axes.

Advantageous modifications of the invention are defined by the features and feature combinations of the corresponding dependent claims.

The invention has a special advantage that force transfer of the two eccentric drives of the horizontal drive is restricted spatially to a very narrow, compact region of attack and therefore leads to stable guiding of the drive movement of the two eccentric drives. The invention is freed of the stipulation that a horizontal drive that generates a vertical motion component, in addition to the horizontal motion component, is fully unsuited for a horizontal drive of the bar carrier. The vertical movement of the needles guided on the needle bar occurs exclusively through the vertical drive, so that the horizontal drive has to generate a pure horizontal movement, in order to compensate for the advance movement of the nonwoven web. To this extent, a vertical movement component triggered by the horizontal drive is avoided. However, the invention recognized that the combination of connecting rods held in the oblique position with the horizontal linkage can be advantageously utilized, in order to exclusively transfer the horizontally directed forces to the bar carrier. The movement component generated via the eccentric drives in the vertical direction is absorbed via the horizontal linkage and not transferred to the bar carrier. To this extent, the high flexibility of stroke adjustments caused by the two eccentric drives can be advantageously connected with stability and rigidity of force transfer.

An improvement in stability of the horizontal drive can be achieved, in particular, by a modification of the invention, in which the connecting rod top ends of the connecting rods are coupled to the horizontal linkage through a double rotating linkage. Force engagement can therefore be concentrated on a coupling point that is guided together via the eccentric drives. The double pivot point is always guided by the eccentric drives on a path similar to an ellipse, whose width and height depends on the phase position of the two eccentric drives. As extreme case, either a roughly vertical or exactly horizontal line is obtained for maximum or minimum horizontal stroke.

The double pivot point for connecting the connecting rods can be formed both directly on one end of the horizontal linkage or advantageously on the coupling element of a coupling kinematics connected to the horizontal linkage.

During use of a coupling kinematics, the possibility is offered of reducing the force acting on the horizontal drive. In addition, axial guiding of the needle bar can be advantageously stabilized.

In order to obtain higher flexibility in arrangement and formation of the eccentric drives, according to an advantageous modification of the invention, there is the alternative possibility of coupling the connecting rod top ends of the connection rods through two pivot points with the horizontal linkage. The pivot points here are preferably formed in the immediate vicinity or slightly offset relative to each other directly on one end of the horizontal linkage. However, in principle, there is also the possibility of forming the pivot point of the two connecting rods on a coupling element connected via coupling kinematics to the horizontal linkage.

In order to change the stroke movement of the needle bar in its size, initiated by the eccentric drives, the modification of the invention, in which the coupling kinematics is formed from a coupling element connected to the eccentric drives and a toggle lever mounted on a pivot bearing has proven itself, in particular. Here, the coupling element, as a pushrod, and the horizontal linkage preferably engage on the toggle lever offset relative to each other, so that the eccentric movements are transferred to the needle bar with a transmission ratio. Even with relatively small eccentric movements of the eccentric drives, relatively large strokes on the needle bar and vice versa can be initiated.

In order to permit sufficient horizontal movement of the eccentric drives, in addition to stability, according to a preferred modification of the invention, the oblique position of the connecting rods is chosen, so that the angle between the center axes of the connecting rod is also <180°. Arrangements can therefore be implemented that represent a compromise between the favorable movement form and favorable force relations on the connecting rods.

The crankshafts of the eccentric drives are then driven oppositely, the phase positions of the two crankshafts being made adjustable independently of each other for adjustment of a stroke.

According to a preferred modification of the invention, separate servomotors are assigned to the crankshafts, through which the phase position of the crankshafts is adjustable. The servomotors can then be driven via a common control device according to the desired stroke settings.

According to a preferred modification of the invention, the horizontal linkage is arranged with its end on the middle area of the bar carrier and connected to the bar carrier through a pivot point. The shear and tensile forces introduced for horizontal deflection can therefore be directly introduced to the bar carrier independently of the vertical movements of the bar carrier. A load acting on the bar carrier through bending moments, as well as transfer vertical movements generated by the eccentric drives, can be avoided on this account.

The position of the horizontal linkage is suitable, in particular, to guide the bar carrier in the bar longitudinal direction. For this purpose, according to an advantageous modification of the invention, the horizontal linkage is arranged essentially parallel to a transverse side of the bar carrier and designed with a stiffening shape, so that the bar carrier is guided in the longitudinal direction. The device can also be reliably operated with the horizontal drive not activated. In this case, the bar carrier would only be driven by the vertical drive in an up and down movement.

In order to produce qualitatively high-value needling of the nonwoven web, the needles are preferably driven in the vertical direction according to a modification of the invention with a vertical drive formed by two eccentric drives, each of which has a crankshaft and a connecting rod connected to the crankshaft via a connecting rod head. Connecting rods are connected with their connecting rod top ends to the bar carrier via pivot points. This type of vertical drive offers high flexibility for adjustment and guiding of the needle bar, in order to needle different nonwoven webs with different fibers product-specifically.

BRIEF DESCRIPTION OF THE SEVERAL VIEWS OF THE DRAWINGS

A practical example of the device according to the invention is further explained below with reference to the accompanying figures.

In the figures.

DETAILED DESCRIPTION

Figure 1:
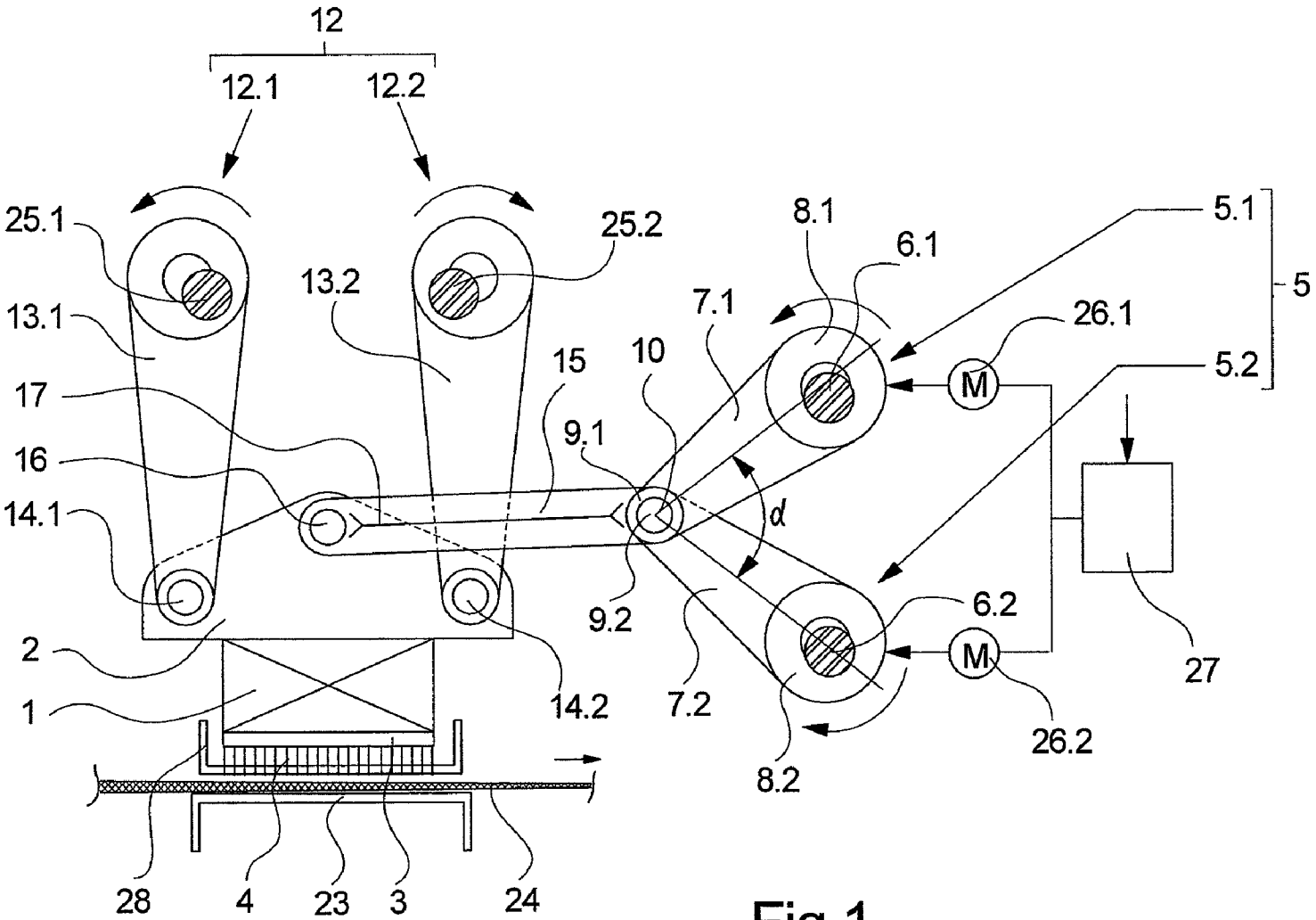
FIG. 1: schematically depicts a side view of a first practical example of the device according to the invention.

A first practical example of the device according to the invention for needling of a nonwoven web is shown in FIG. 1. The practical example of the device according to the invention according to FIG. 1 has a bar carrier 2, which holds a needle bar 1 on its bottom. The needle bar 1 holds on its bottom a needle board 3 with a number of needles 4. A tray 23 and a stripper 28 are assigned to the needle board 3 with needles 4, in which a nonwoven web 24 is guided at essentially constant advance speed between the tray 23 and the stripper 28. The movement direction of the nonwoven web 24 is marked here by an arrow.

A vertical drive 12 and a horizontal drive 5 engage on the bar carrier 2. Through the vertical drive 12, the bar carrier 2 is moved in oscillating fashion in the vertical direction, so that the needle bar 1 with needle board 3 executes an up and down movement. The vertical drive 12 is formed by two parallel eccentric drives 12.1 and 12.2. The eccentric drives 12.1 and 12.2 have two parallel-arranged crankshafts 25.1 and 25.2, which are arranged above the bar carrier 2. The crankshafts 25.1 and 25.2 each have at least one eccentric section to accommodate at least one connecting rod. The connecting rods 13.1 and 13.2 arranged on a bar carrier 2 are shown in FIG. 1, which are held with their connecting heads on the crankshafts 25.1 and 25.2. The connecting rods 13.1 and 13.2 are connected to the bar carrier 2 with their free ends through connecting rod pivot points 14.1 and 14.2. The crankshaft 25.1 forms with the connecting rod 13.1 and the crankshaft 25.2 forms with the connecting rod 13.2 an eccentric drive, in order to guide the bar carrier 2 in an up and down movement. The crankshafts 25.1 and 25.2 are driven synchronously in the same or opposite direction, so that the bar carrier 2 is guided at least roughly parallel.

It should be explicitly mentioned at this point that several vertical drives could engage on the bar carrier, so that connecting rods would be coupled to the bar carrier 2 via the connecting rod pivot points on both ends of the bar carrier 2. To this extent, an identical arrangement of the eccentric drives would be provided on an opposite end of the bar carrier (not shown).

For superimposed horizontal movement of the bar carrier 2, the horizontal drive 5 engages with two eccentric drives 5.1 and 5.2 on the bar carrier 2. The horizontal drive 5 is connected to the bar carrier 2 via a horizontal linkage 15. For this purpose, a free end of the horizontal linkage 15 is arranged in the middle area of the bar carrier 2 via a pivot point 16. The opposite end of the horizontal linkage 15 is connected via a double pivot point 10 to the eccentric drives 5.1 and 5.2. In this practical example, the eccentric drives 5.1 and 5.2 are formed by two parallel crankshafts 6.1 and 6.2. The crankshafts 6.1 and 6.2 each have at least one eccentric section, in order to drive at least one connecting rod. A connecting rod 7.1 is coupled with its connecting head 8.1 to the crankshaft 6.1. The connecting rod 7.2 is connected with its connecting head 8.2 to the crankshaft 6.2 arranged at a spacing. The connecting rods 7.1 and 7.2 are directed toward each other in an oblique position, so that the connecting rod 9.1 of connecting rod 7.1 and the connecting rod top end 9.2 of connecting rod 7.2 are together connected to the horizontal linkage 15 by the double pivot point 10. The double pivot point 10 therefore forms a common coupling point for force transfer of the two eccentric drives 5.1 and 5.2. The pivot point 10 is situated at the intersection of the side axes of the connecting rods 7.1 and 7.2, so that an angle is set between the center axes of the connecting rods 7.1 and 7.2. The angle between the connecting rods 7.1 and 7.2 is marked $\alpha$ in FIG. 1. Angle $\alpha$ is essentially dependent on the position of crankshafts 6.1 and 6.2 and is preferably made with an angle<180°, in order to obtain sufficient horizontal deflection at the common coupling point with maximum stroke setting of the eccentric drives 5.1 and 5.2. Here, the angle $\alpha$ and therefore the arrangement of the connecting rod top ends to each other is chosen, so that a compromise is achieved between a favorable form of movement and favorable force conditions on the connecting rods.

The eccentric drives 5.1 and 5.2 are synchronously driven in the opposite directions to drive the bar carrier 2. The double pivot point 10 is then guided on a path in the shape of an ellipse as common coupling point of the two connecting rods 7.1 and 7.2

The horizontal component of movement is transferred via the horizontal linkage 15 and the pivot point 16 directly to the bar carrier 2. The vertical component of the movement generated by the eccentric drives 5.1 and 5.2, however, leads only to a rotary movement of the horizontal linkage 15 around the pivot point 16. The vertical movements generated by the horizontal drive 5 in the double pivot point 10 therefore essentially have no effect on the bar carrier 2. Through the horizontal linkage 15, only horizontally directed forces can be transferred via the pivot point 16, which lead to a corresponding horizontal movement of the bar carrier 2.

The crankshafts 6.1 and 6.2 can be driven for this purpose jointly by one drive or separately via separate drives. In order to adjust the stroke of the horizontal movement of the bar carrier, the phase position of the crankshafts 6.1 and 6.2 are adjusted relative to each other. The phase position and therefore the desired horizontal stroke of the crankshafts occur in this practical example through two servomotors 26.1 and 26.2, which are schematically depicted in FIG. 1. The servomotors 26.1 and 26.2 are assigned to the crankshafts 6.1 and 6.2 and connected in a common control device 27. Any combinations of phase positions between crankshafts 6.1 and 6.2 can therefore be adjusted by the control device 27. The double pivot point 10 is guided as a common coupling point on a guide path similar to an ellipse, whose width and height depends on the phase position of the two crankshafts. As an extreme case, either roughly a vertical or precisely a horizontal linkage path is obtained for maximum or minimum horizontal stroke.

In the situation depicted in FIG. 1, the bar carrier 2 is situated to the left of the neutral position relative to its horizontal position and in an upper intermediate position in the vertical direction. With continuing drive, the bar carrier 2 is guided back and forth with the bar carrier 1 horizontally with a predefined stroke. Horizontal movement then occurs with the needles 4 inserted into the nonwoven web 24 in the advance direction of nonwoven web 24, so that essentially no deformations and no relative movements between the needles 4 and the nonwoven web 24 occur. The horizontal linkage 15 then simultaneously causes guiding of the bar carrier 2, active relative to vertical drive 12, especially in the bar longitudinal direction. For this purpose, the horizontal linkage 15 is formed in a stiffening shape, shown in this practical example by a stiffening rib 17. The bar carrier 2 is guided by the horizontal linkage 15 arranged on the transverse sides of the bar carrier 2, so that the bar carrier 2 could also be reliably operated without activation of the horizontal drive 5.

In the practical example depicted in FIG. 1, the vertical drive 12 and the horizontal drive 5 are driven synchronously for needling of the nonwoven web 24, in which the downward movement of the bar carrier 2 is combined with an advance movement, so that the needles 4 can execute a movement within nonwoven web 24 directed in the guide direction of nonwoven web 24.

In the practical example depicted in FIG. 1, a needle bar 1 is held on the bar carrier 2. In principle, however, there is the possibility of also arranging several needle bars 1 on a bottom of bar carrier 2. A bar carrier 2 is guided by at least one vertical drive 12. Generally, a number of these units are present in a machine, in which not each bar carrier need be guided by at least one horizontal drive. Several bar carriers could also be connected to a needle bar, so that only one horizontal drive would guide the unit of a needle bar and several bar carrier in a machine.

Figure 2:
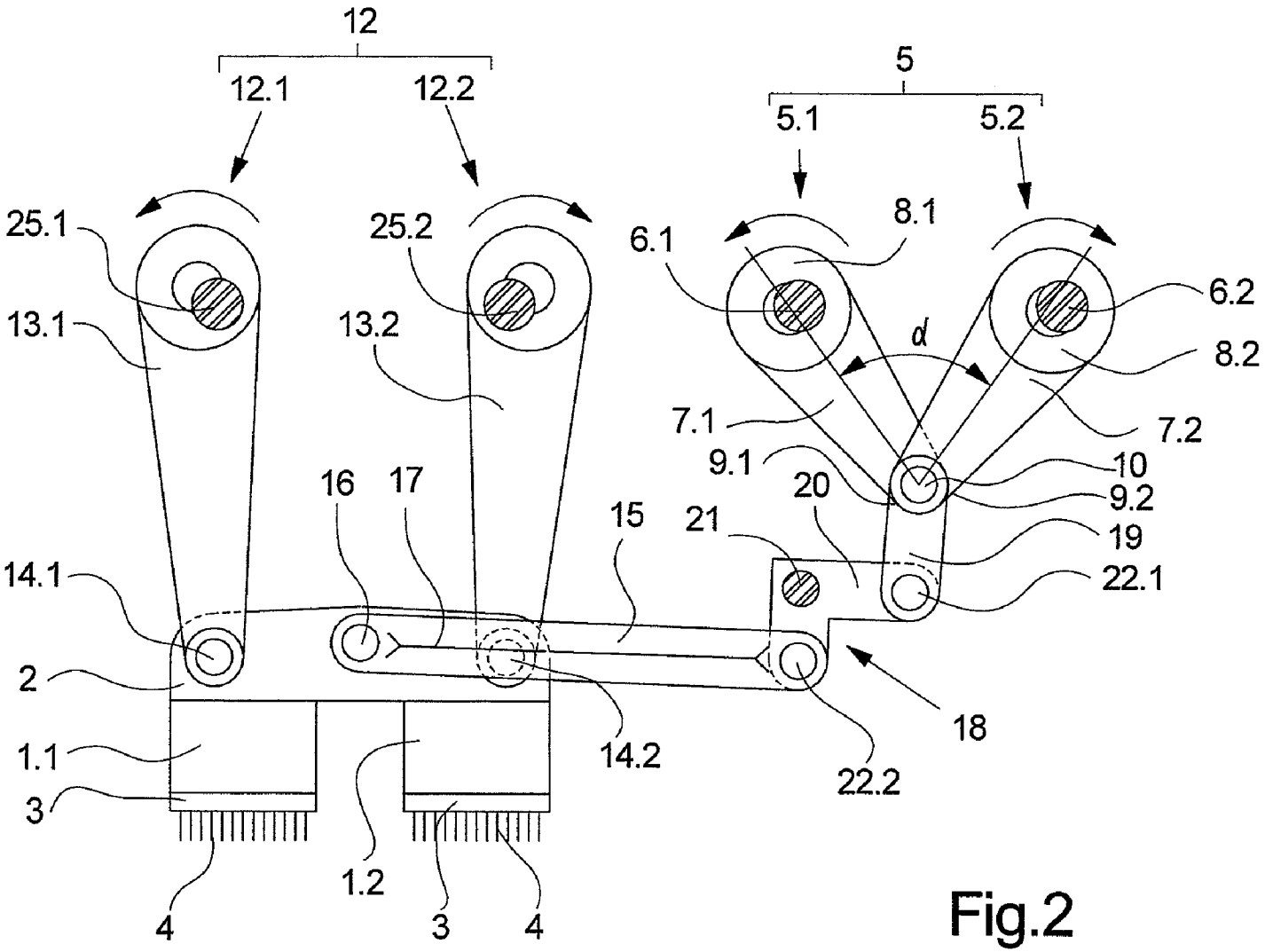
FIG. 2: schematically depicts a side view of another practical example of the device according to the invention.

Another practical example of the device according to the invention is schematically depicted as a side view in FIG. 2. The practical example according to FIG. 2 is essentially identical to the practical example according to FIG. 1, so that only the differences are explained here and otherwise reference is made to the aforementioned description.

In the practical example depicted in FIG. 2, two needle bars 1.1 and 1.2 are secured on the bar carrier 2, each of which carries on its bottoms a needle board 3 and a number of needles 4. The bar carrier 2 is coupled to a vertical drive 12, which is designed identical to the aforementioned practical example. For horizontal movement of the bar carrier 2, the bar carrier 2 is connected to a horizontal linkage 15 via a center pivot point 16. In this practical example, the pivot point 16 is arranged essentially with the connecting rod linkages 14.1 and 14.2 on the bar carrier 2 at a common height, so that the horizontal linkages 15 arranged on the transverse sides of the bar carrier 2 permit guiding aligned with the force introduction on the bar carrier 2.

A horizontal drive 5 is provided for deflection of the horizontal linkage 15, which is formed by the eccentric drives 5.1 and 5.2. Here, the eccentric drives 5.1 and 5.2 each have a crankshaft 6.1 and 6.2, which are arranged above the bar carrier 2 in contrast to the previous practical example. Consequently, there is a possibility that the crankshaft drives of the vertical drive 12 and the horizontal drive 5 can be arranged in a common machine plane.

For force transfer between the horizontal drive 5 and the horizontal linkage 15, a coupling mechanism 18 is provided. The coupling mechanism 18 in this practical example consists of a toggle lever 20, which is mounted to pivot on a pivot bearing 21. The toggle lever 20 has a pivot point 22.2 on a free end beneath the pivot bearing 21, with which the horizontal linkage 15 is connected to the toggle lever 20. The toggle lever 20 is designed L-shaped and has a second pivot point 22.1 on a second free end, on which a coupling element engages in the form of a pushrod 19. The pushrod 19 is coupled with an opposite end to the connecting rod top ends 9.1 and 9.2 of connecting rods 7.1 and 7.2 by the double pivot point 10. The connecting rods 7.1 and 7.2 are arranged in an oblique position and e connected via their connecting heads 8.1 and 8.2 to the crankshafts 6.1 and 6.2 arranged parallel next to each other. The center axes of the connecting rods 7.1 and 7.2 form the angle $\alpha$, which in this case also has a size of less than 180°.

The crankshafts 6.1 and 6.2 are driven oppositely with the same speed, in which the phase positions of the crankshafts 6.1 and 6.2 are adjusted relative to each other as a function of a desired horizontal stroke. Adjustment of the phase positions in crankshafts 6.1 and 6.2 can then occur as already described in the practical example according to FIG. 1.

During drive of crankshafts 6.1 and 6.2, the connecting rods 7.1 and 7.2 are deflected, so that they move the double pivot point on a guide path in the common coupling point. This movement, transferred directly to the pushrod 19, is transferred from the pushrod 19 by a toggle lever 20 to a horizontal linkage 15. Because of the offset arrangement of pivot points 21.1 and 21.2 of the pushrod 19 and the horizontal linkage 15, the stroke movement produced by the eccentric drives 5.1 and 5.2 is transferred with a transmission ratio to the bar carrier 2. In relation to the double pivot point 10, the bar carrier 2 therefore executes a stroke movement altered by the transmission ratio, in this case, a smaller stroke movement.

The practical example of the device according to the invention depicted in FIG. 2 represents only an additional possibility, in order to connect the two eccentric drives 5.1 and 5.2 of the horizontal drive 5 via a coupling mechanism 18 to the horizontal linkage 15. In this case, both force transfer of the horizontal linkage 15 to the bar carrier 2 and the stroke movement of the horizontal linkage 15 on the bar carrier 2 can be influenced. In addition, greater flexibility is obtained in the arrangement of the horizontal drive. The eccentric drives 5.1 and 5.2 of the horizontal drive 5 and the eccentric drives 12.1 and 12.2 of the vertical drive 12 can thus be arranged in a common upper machine plane.

Figure 3:
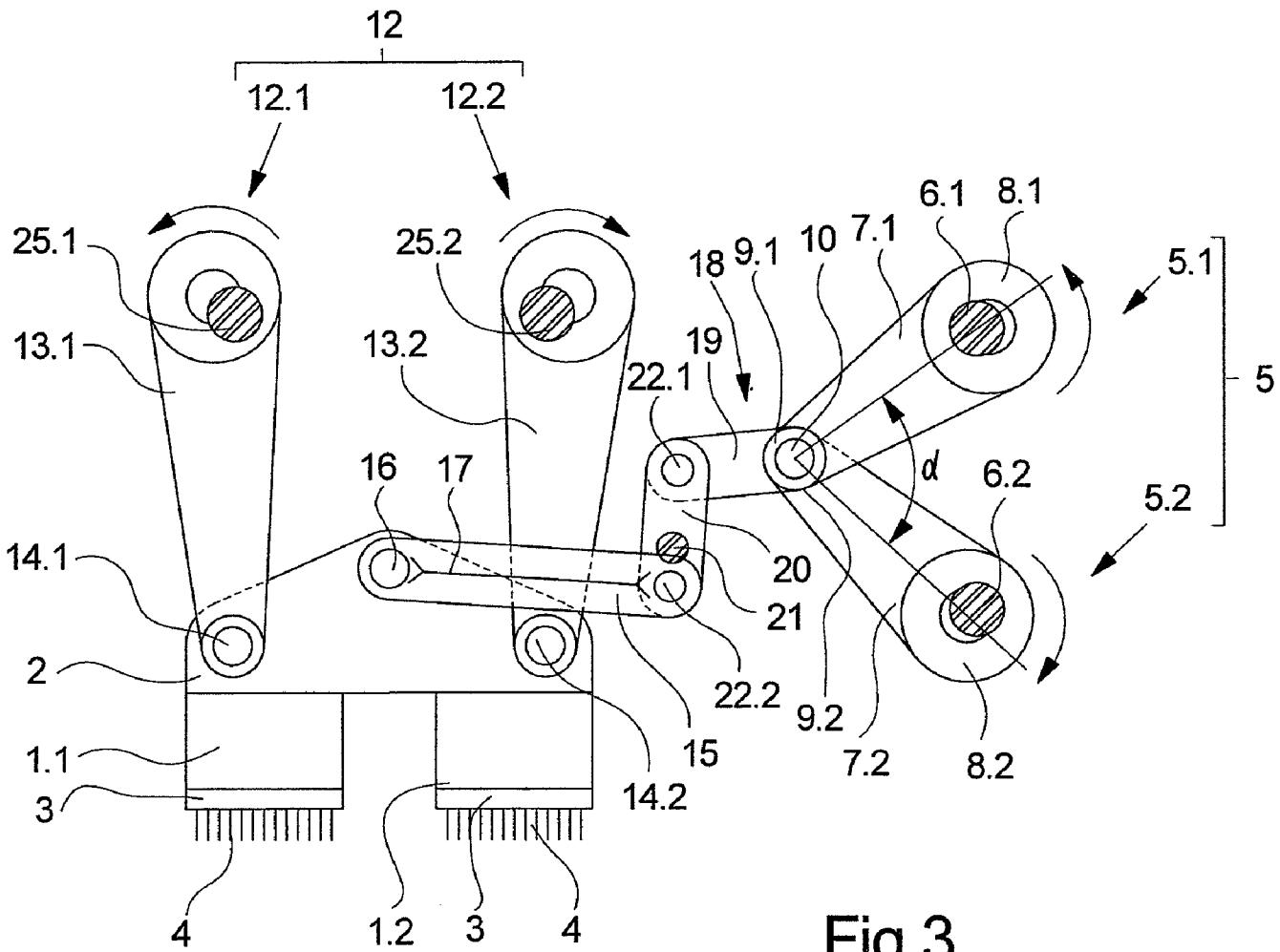
FIG. 3: schematically depicts a side view of another practical example of the device according to the invention.

However, in principle, there is also the possibility of modifying the practical example depicted in FIG. 1, so that a coupling mechanism 18 is arranged between the horizontal drive 5 and the horizontal linkage 15. This design is shown, for example, in FIG. 3. The practical example depicted in FIG. 3 is largely identical to the practical example according to FIG. 1 and differs only by the intermediate connection of a coupling mechanism 18. Here, the coupling mechanism 18 is formed by a toggle lever 20 and a coupling element 19, in which the coupling element is also designed here as a pushrod 19. The toggle lever 20 is secured on a pivot bearing 21 and has a pivot point 22 on a lower end beneath the pivot bearing 21 for connection of the horizontal linkage 15. On an upper end above the pivot bearing 21, the toggle lever 20 is connected to the pushrod 19 via the pivot point 22.1. The pushrod 19 is coupled via the double pivot point 10 to the connecting rods 7.1 and 7.2 of eccentric drives 5.1 and 5.2.

The eccentric drives 5.1 and 5.2 of the horizontal drive 5 are designed identical to the practical example according to FIG. 1, so that no additional explanation occurs for this purpose. By intermediate connection of the coupling mechanism 18 between the eccentric drives 5.1 and 5.2 and the horizontal linkage 15, any desired transmission ratio can be set, depending on the design of the lever mechanism of the coupling mechanism 18. The horizontal stroke and force introduction in the bar carrier 2 can thus be influenced to guide the needle bars 1.1 and 1.2.

In the practical example depicted in FIG. 3, two needle bars 1.1 and 1.2 are secured on the bar carrier 2. Each of the needle bars has a needle board 3 with a number of needles 4. The needle bars 1.1 and 1.2 are assigned to a tray not shown here, in which a nonwoven web is guided.

The vertical drive 12 engaging on the bar carrier 2 is identical to the aforementioned practical example, so that no additional explanation occurs for this purpose.

Figure 4:
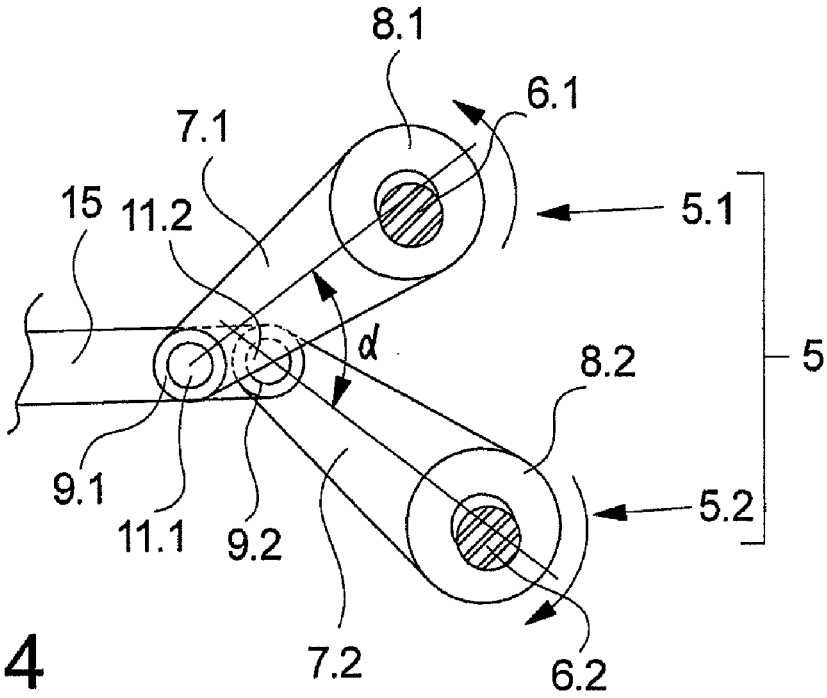
FIG. 4.

In the practical examples of the device according to the invention depicted in FIGS. 1 to 3, the movement of the horizontal drive 5 is released via the two connecting rods 7.1 and 7.2 through a common coupling point formed by the double pivot point 10. In principle, however, there is also the possibility of connecting the connecting rod top ends 9.1 and 9.2 of the connecting rods 7.1 and 7.2 in an offset arrangement to a horizontal linkage 15 or coupling element, for example, pushrod 19. For example, an arrangement is shown in FIG. 4, in which the connecting rods 7.1 and 7.2 of the eccentric drives 5.1 and 5.2 are connected offset relative to each other by the pivot points 11.1 and 11.2 with a horizontal drive 15. The pivot points 11.1 and 11.2 are held offset to each other with their axes of rotation. The size of the offset is chosen here as an example. The connecting rods 7.1 and 7.2 of the eccentric drives 5.1 and 5.2 here also form an angle $\alpha$ with their center axes, in which the axes of rotation of the pivot points 11.1 and 11.2 need not necessarily lie at the crest of the angle. In the variant depicted in FIG. 4, the crankshafts 6.1 and 6.2 are arranged offset relative to each other, so that the connecting rods 7.1 and 7.2 are designed with the same length. In principle, however, there is also the possibility of making the connecting rods 7.1 and 7.2 in different lengths, so that the crankshafts 6.1 and 6.2 can be held in a vertically aligned machine plane.

Figure 5:
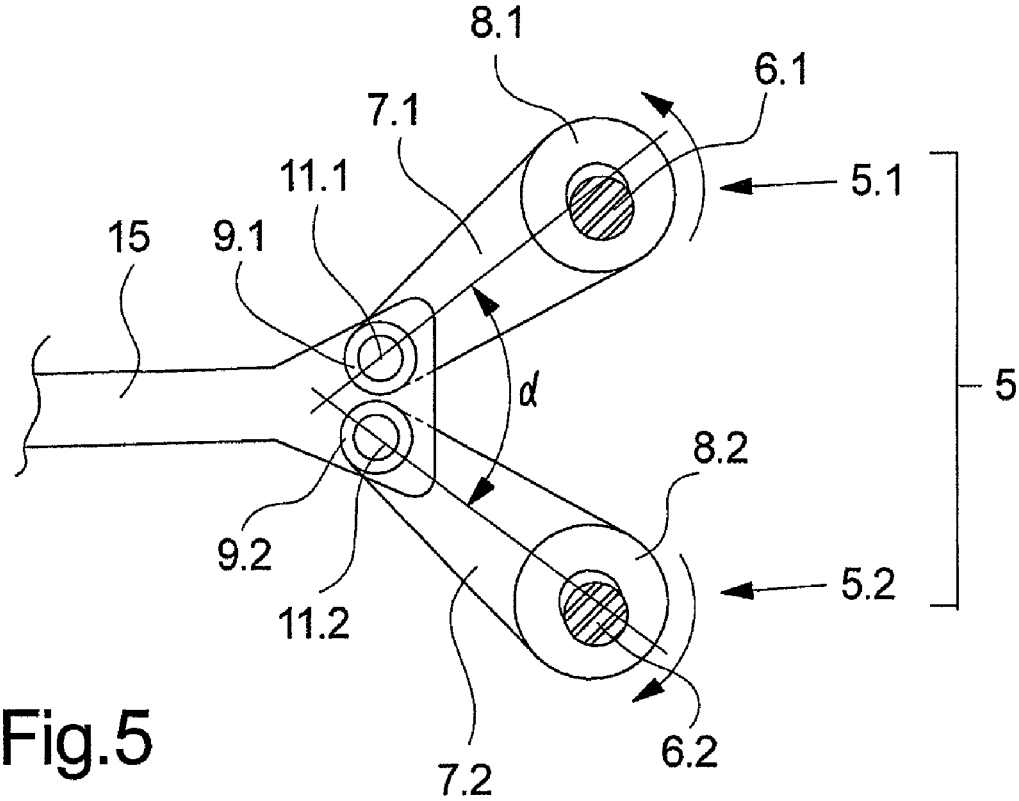
FIG. 5: schematically depict additional practical examples of a horizontal drive for the practical examples according to FIGS. 1, 2 and 3.

Another variant for designing the horizontal drive 5 is shown in FIG. 5. In this case, the pivot points 11.1 and 11.2 are designed offset relative to each other in the vertical direction to connect the connecting rods 7.1 and 7.2. The connecting rod top ends 9.1 and 9.2 are coupled to the horizontal linkage 15 via pivot points 11.1 and 11.2. The crankshafts 6.1 and 6.2 assigned to the connecting rods 7.1 and 7.2 are connected to the connecting rods 7.1 and 7.2 via the connecting heads 8.1 and 8.2.

In the variants for connection of the horizontal drive 5 to the horizontal linkage 15 depicted in FIGS. 4 and 5, the pivot points 11.1 and 11.2 are each formed on the horizontal linkage 15. In principle, however, there is also the possibility that the pivot points 11.1 and 11.2 are formed on a coupling element of a coupling mechanism, for example, on the pushrod 19 of the coupling mechanism 18 depicted in FIGS. 2 and 3.

Figure 6:
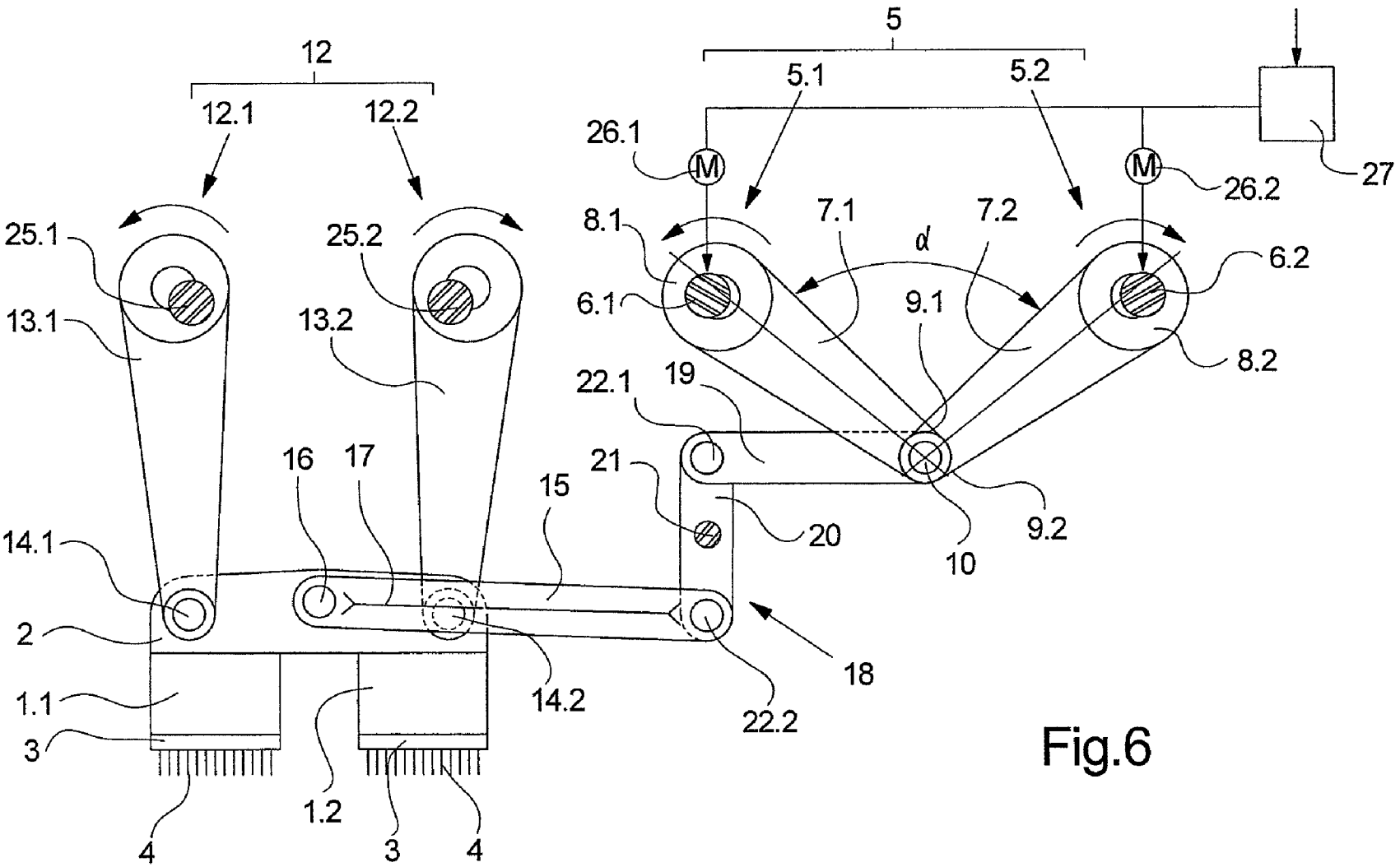
FIG. 6: schematically depicts a side view of another practical example of the device according to the invention.

Another practical example of the device according to the invention is schematically depicted in a side view in FIG. 6. The practical example is essentially identical to the practical example according to FIG. 2, so that reference is made to the aforementioned description to explain the device parts and only the differences are explained here.

In the practical example according to FIG. 6, the horizontal drive 5 is formed by the eccentric drives 5.1 and 5.2. The crankshafts 6.1 and 6.2 of the eccentric drives 5.1 and 5.2 are arranged above the bar carrier 2 jointly with the crankshafts 25.1 and 25.2 of the vertical drive 12 in a machine plane. The connecting rods 7.1 and 7.2 assigned to the eccentric drives 5.1 and 5.2 of the horizontal drive are connected via a coupling mechanism 18 to the horizontal linkage 15. The coupling mechanism 18 is formed by a toggle lever 20 and a pushrod 19. The connecting rods 7.1 and 7.2 then engage on a free end of the pushrod 19 via a double pivot point 10. On the opposite end of pushrod 19, the toggle lever 20 is connected via pivot point 22.1. The toggle lever 20, which has an elongated shape, is mounted to pivot in a center area on the pivot bearing 21. On the opposite end to pivot point 22.1, the toggle lever 20 is connected to the horizontal linkage 15 via an additional pivot point 22.2.

The connecting rods 7.1 and 7.2 form an angle $\alpha$ that is <180° with their center axes.

Relative to the practical example according to FIG. 2, in the practical example according to FIG. 6, a phase shift device is assigned to the horizontal drive 5. For this purpose, a first servomotor 26.1 engages on the crankshaft 6.1 and a second servomotor 26.2 engages on the crankshaft 6.2. The servomotors 26.1 and 26.2 are controllable independently of each other via a control device 27. By activation of the servomotors 26.1 and 26.2 or only one of the motors, the phase positions of the crankshafts 6.1 and 6.2 can be adjusted relative to each other, so that the motion path of the double pivot point 10 is variable. The double pivot point 10, which forms the coupling point of the connecting rods 7.1 and 7.2, is always moved on a path similar to an ellipse, whose width and height would depend on the phase position of the two crankshafts. As an extreme case, either roughly a horizontal or precisely vertical line is obtained for the maximum and minimum horizontal stroke. By adjusting the phase position of the crankshafts 6.1 and 6.2, a desired length of the horizontal stroke can therefore advantageously be adjusted.

The movement of the connecting rods can be transferred with particular advantage to the bar carrier 2 via the pushrod 19 and the horizontal linkage 15, as well as toggle lever 20, so that the movement direction is reversed. At least part of the horizontal inertia can therefore be compensated. By appropriate choice of the length ratios, the effect of the horizontal linkage 15 on bar movement can be compensated by the pushrod 19, so that a straight guide path is produced with very good approximation during a null stroke. In this practical example, the crankshafts 6.1 and 6.2 of the horizontal drive 5 are driven oppositely. The movement direction of crankshafts 6.1 and 6.2 is marked in FIG. 6 by an arrow.

The device according to the invention is particularly suited to execute mechanical needling of nonwoven webs with high production output and high production speeds with very low horizontal stroke. In particular, because of the high stability of the horizontal drive, despite variable stroke adjustment, a high uniform needling quality can be achieved during structuring of nonwovens even at the highest production speeds. In addition, a very compact design with limited space requirements is created. The simple drive kinematics for controlling the horizontal linkage, as well as the stiffening form of the horizontal linkage for axial guiding of the bar carrier, permit a design with few parts and low weight. Very high movement frequencies of the bar carrier are therefore attainable, since the compact design permits a rigid structure of the machine frame.

The vertical drive of the horizontal drive can be driven both synchronously and asynchronously for movement of the bar carrier. Here, the eccentric drives can be driven with any phase adjustments, so that high flexibility is offered for movement control of the bar carrier.

The invention claimed is:

1. A device for needling of a nonwoven web, said device comprising:

at least one needle bar, which has a needle board with a number of needles on its bottom;

a movably mounted bar carrier for holding the needle bar;

a vertical drive connected to the bar carrier for oscillating movement of the bar carrier in an up and down movement;

a separate horizontal drive for oscillating movement of the bar carrier in a back and forth movement, the horizontal drive having at least one horizontal linkage connected to the bar carrier and two eccentric drives connected to the horizontal linkage, in which each of the eccentric drives is formed by a connecting rod and a crankshaft coupled to a connecting head of the connecting rod, wherein the connecting rods are coupled with connecting rod top ends in an oblique position to the horizontal linkage, the connecting rods forming an angle ($\alpha$) with their center axes.

2. The device according to claim 1, wherein the connecting rod top ends of the connecting rods are coupled to the horizontal linkage via a double pivot point.

3. The device according to claim 2, wherein the double pivot point is formed directly on one end of the horizontal linkage or on a coupling element of a coupling mechanism connected to the horizontal linkage.

4. The device according to claim 1, wherein the connecting rod top ends of the connecting rods are connected to the horizontal linkage by two pivot points.

5. The device according to claim 4, wherein the pivot points are formed directly on one end of the horizontal linkage or on a coupling element of a coupling mechanism connected to the horizontal linkage.

6. The device according to claim 3, wherein the coupling mechanism is formed by a toggle lever secured via a pivot bearing and the coupling element, in which the coupling element is connected as a pushrod with one end via the double pivot point to the connecting rod top ends of the connecting rods and with the other end to the toggle lever, in which the horizontal linkage is connected to the toggle lever, and in which transmission in the coupling mechanism is present via the arm lengths of the toggle lever.

7. The device according to claim 6, wherein the coupling element and the horizontal linkage are connected offset relative to each other to the toggle lever via pivot points.

8. The device according to claim 1, wherein the oblique position of the connecting rod is chosen so that the angle ($\alpha$) between the center axes of the connecting rod is less than 180°.

9. The device according to claim 1, wherein the crankshafts of the eccentric drives can be driven oppositely, the phase position of the two crankshafts being designed adjustable for adjustment of a stroke.

10. The device according to claim 9, wherein separate servomotors are assigned to the crankshafts to adjust the phase position, which are designed controllable independently of each other via control device.

11. The device according to claim 1, wherein the horizontal linkage is connected with its end in a center area of the bar carrier to the bar carrier via a pivot point.

12. The device according to claim 11, wherein the horizontal linkage runs essentially parallel to a transverse side of the bar carrier and has a stiffening shape to guide the bar carrier in the longitudinal direction.

13. The device according to claim 1, wherein the vertical drive is formed by two eccentric drives, each of which has a crankshaft and a connecting rod connected to the crankshaft, the connecting rods being connected to the bar carrier via connecting linkages.

14. The device according to claim 5, wherein the coupling mechanism is formed by a toggle lever secured via a pivot bearing and the coupling element, in which the coupling element is connected as a pushrod with one end via the pivot points to the connecting rod top ends of the connecting rods and with the other end to the toggle lever, in which the horizontal linkage is connected to the toggle lever, and in which transmission in the coupling mechanism is present via the arm lengths of the toggle lever.

15. The device according to claim 14, wherein the coupling element and the horizontal linkage are connected offset relative to each other to the toggle lever via pivot points.

* * * * *